US006564770B1

(12) United States Patent
Cathcart

(10) Patent No.: US 6,564,770 B1
(45) Date of Patent: May 20, 2003

(54) METHOD OF INJECTION OF A FUEL-GAS MIXTURE TO AN ENGINE

(75) Inventor: Geoffrey Paul Cathcart, Yokine (AU)

(73) Assignee: Orbital Engine Company (Australia) Pty. Limited, Balcatta (AU)

( * ) Notice: Subject to any disclaimer, the term of this patent is extended or adjusted under 35 U.S.C. 154(b) by 0 days.

(21) Appl. No.: 09/554,616

(22) PCT Filed: Dec. 3, 1998

(86) PCT No.: PCT/AU98/01004

§ 371 (c)(1),
(2), (4) Date: Jun. 1, 2000

(87) PCT Pub. No.: WO99/28621

PCT Pub. Date: Jun. 10, 1999

(30) Foreign Application Priority Data

Dec. 3, 1997 (AU) ..... PP0704

(51) Int. Cl.[7] ..... F02B 3/00; F02M 21/02; F02M 23/00

(52) U.S. Cl. ..... 123/299; 123/525; 123/531

(58) Field of Search ..... 123/295, 299, 123/300, 304, 305, 26, 308, 430, 443, 585, 27 GE, 525, 527, 575, 531

(56) References Cited

U.S. PATENT DOCUMENTS

| | | | | | |
|---|---|---|---|---|---|
| 4,754,735 | A | * | 7/1988 | Simons | 123/478 |
| 4,800,862 | A | * | 1/1989 | McKay et al. | 123/531 |
| 4,817,873 | A | * | 4/1989 | McKay | 239/397.5 |
| 4,823,756 | A | * | 4/1989 | Ziejewski et al. | 123/531 |
| 4,846,114 | A | * | 7/1989 | List | 123/26 |
| 5,048,497 | A | * | 9/1991 | Kishida et al. | 123/533 |
| 5,095,873 | A | * | 3/1992 | Motoyama et al. | 123/305 |
| 5,195,482 | A | * | 3/1993 | Smith | 123/198 A |
| 5,603,301 | A | * | 2/1997 | Sakurai et al. | 123/430 |
| 5,829,407 | A | * | 11/1998 | Watson et al. | 123/275 |
| 5,996,558 | A | * | 12/1999 | Ouellette et al. | 123/506 |
| 6,073,862 | A | * | 6/2000 | Touchette et al. | 239/408 |
| 6,109,536 | A | * | 8/2000 | English | 239/5 |
| 6,161,525 | A | * | 12/2000 | Ficht | 123/495 |
| 6,161,527 | A | * | 12/2000 | Ruman | 123/533 |
| 6,202,601 | B1 | * | 3/2001 | Ouellette et al. | 123/27 GE |
| 6,336,598 | B1 | * | 1/2002 | Touchette et al. | 239/408 |
| 2001/0056322 | A1 | * | 12/2001 | Yoshizawa et al. | 701/104 |
| 2002/0002967 | A1 | * | 1/2002 | Paul et al. | 123/525 |

FOREIGN PATENT DOCUMENTS

| | | | | |
|---|---|---|---|---|
| DE | 44 14 906 | | 5/1995 | |
| EP | 0 348 865 | | 1/1990 | |
| EP | 0 421 356 | | 4/1991 | |
| JP | 264810 | * | 9/1994 | F02M/41/36 |
| JP | 179433 | * | 6/2000 | F02M/67/02 |
| JP | 193463 | * | 7/2001 | F02B/1/12 |

* cited by examiner

*Primary Examiner*—Henry C. Yuen
*Assistant Examiner*—Hai Huynh
(74) *Attorney, Agent, or Firm*—Arent, Fox, Kintner, Plotkin & Kahn, PLLC

(57) ABSTRACT

Disclosed is a method of fuelling an internal combustion engine by injection of a fuel-gas mixture to a combustion chamber of the engine comprising delivering a metered quantity of fuel from a fuel metering means to a delivery injector operation, the delivery injector being in communication with both the combustion chamber and a supply of pressurized gas for effecting delivery of the metered quantity of fuel to the combustion chamber, wherein at least one of the fuel metering means and the delivery injector are controlled in multiple events and a predetermined fuel distribution in the combustion chamber at ignition during that cycle of engine operation.

82 Claims, 3 Drawing Sheets

METHOD OF INJECTION OF A FUEL-GAS MIXTURE TO AN ENGINE

Figure 1:
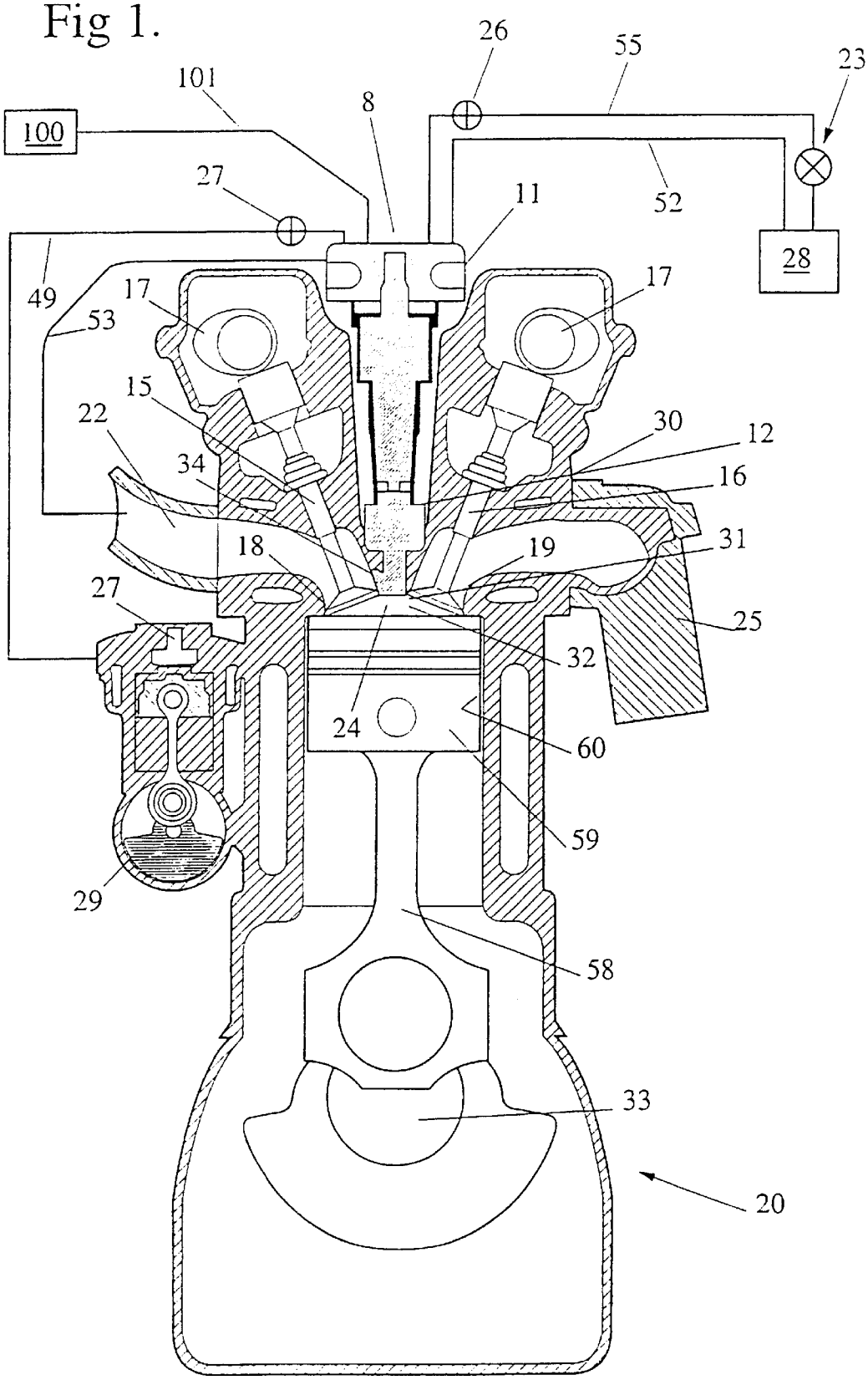

This invention relates to fuelling of engines by injection of fuel-gas mixtures to combustion chambers of the internal combustion engines typically operating on either the two or four stroke cycle.

The advantages in terms of low emissions in exhaust gases from internal combustion engines having combustion chambers or cylinders directly injected with fuel-gas mixtures are recognised and result from better control over fuel distributions and quantities than are possible in carburetted engines, in addition to other factors.

In this respect, it has been disclosed by the Applicant in, for example, U.S. Pat. No. 4,800,862 that, in efforts to control the harmful components in the exhaust gases from engines, control of the fuel distribution in the combustion chamber(s) of the engine may be beneficial. Accordingly, that patent discloses, in particular regard to a dual fluid fuel injection system wherein a gas under pressure is used to entrain and deliver a separately metered quantity of fuel to an engine, control over the introduction of fuel to the gas to obtain a predetermined fuel distribution in the combustion chamber(s) of the engine at the time of ignition. In particular, it is described as most desirable in a spark ignition engine that the predetermined fuel distribution involve a relatively fuel rich mixture in proximity to the ignition means at the time of ignition.

Typically, the ignition means is located in the cylinder head of the engine and accordingly, at ignition, a fuel rich region is desirably formed in this area of the cylinder. In certain engines, typically those having centrally mounted direct injection systems, this is accompanied by an adjacent increase in the air/fuel ratio of the remaining combustion charge in the axial direction of the cylinder (ie. becomes leaner). Such a combustion charge is said to be of stratified type and has recognised advantages at ignition, particularly under low load conditions. Low load conditions may be generally described as a load less than 25% of the maximum load achievable at a particular engine speed.

Typically, the preferred fuel distribution in the cylinder will vary with the engine load and speed and so, as described in the Applicant's U.S. Pat. No. 4,800,862, the rate of introduction of the determined quantities of fuel to the cylinder(s) of the engine is controlled to achieve the most efficient distribution for particular engine operating conditions. Therefore, at high loads it is often more important to have a substantially uniform air/fuel ratio throughout the cylinder such that the fuel is exposed to sufficient air to combust all of the fuel resident within the cylinder. High load may generally be defined as load greater than 75% of the maximum load achievable at a particular engine speed.

It is an object of the present invention to provide a method of fuelling an internal combustion engine which enables efficient operation of the engine with In acceptably low emissions of $NO_x$, hydrocarbons and other pollutants associated with inefficient engine operation.

With this object in view, the present invention provides a method of fuelling an internal combustion engine by injection of a fuel—gas mixture to a combustion chamber of the engine comprising delivering a metered quantity of fuel from a fuel metering means to a delivery injector, the delivery injector being in communication with both the combustion chamber and a supply of pressurised gas for effecting delivery of the metered quantity of fuel to the combustion chamber, wherein at least one of the fuel metering means and the delivery injector are controlled in multiple events and a predetermined fuel distribution is obtained in the combustion chamber at ignition.

The multiple events may occur during a cycle of engine operation to obtain a predetermined fuel distribution in the combustion chamber at ignition during that cycle of engine operation. The fuel metering means may be controlled to effect a single pulse of controlled duration for providing a metered quantity of fuel to the delivery injector. Such a pulse or controlled opening of the fuel metering means may be described as a "fuel metering event".

The metered quantity of fuel is then delivered entrained in pressurised gas to the combustion chamber by opening of the delivery injector, wherein such a pulse or opening of the delivery injector may be described as a "gas supply event". The delivery injector may desirably be controlled to effect a plurality of gas supply events which carry fuel directly into the cylinder or combustion chamber of the engine. The delivery injector may be controlled to effect a plurality of pulses of controlled duration during a single cylinder cycle to deliver the metered quantity of fuel to the engine and to, on occasion, enable a desired engine control strategy to be effected. A cylinder cycle may be defined by that period of piston reciprocation between top dead centre and subsequent return to top dead centre. More compendiously, a cylinder cycle may be measured by that period between the piston having any position in the cylinder and subsequent return to that position. Thus, a repeatable sequence of events may occur over a number of cylinder cycles. The sequence of fuel metering and gas supply events is typically contoured over the 360° or 720° period, depending on whether the engine is to operate on the two or four stroke cycle. Thus, where some of the events in a sequence occur after top dead centre they may be considered to occur during the same cylinder cycle as an earlier such metering or gas supply event that occurred before top dead centre.

The fuel metering means is conveniently in the form of a fuel metering injector and supply of pressurised gas to the delivery injector is typically via a duct or passage communicating the supply of pressurised gas, typically an air compressor, with a holding chamber of the delivery injector. The holding chamber may remain pressurised at all times during engine operation and is preferably selectively communicated directly with the combustion chamber during the plurality of gas or air supply events each cylinder cycle.

In this respect, the method of the present invention may be implemented in a number of ways with the timings of opening/closing of the fuel metering and fuel delivery injectors, otherwise described respectively as the fuel metering and gas supply events, being controllably timed relative to ignition timing, and each other, by the control unit for the engine, typically an electronic control unit. The timing and/or duration of the fuel metering and/or gas supply events may be made a function of engine speed or engine load or both. Further, the fuel metering and gas supply events may in certain applications be overlapped.

While any number of gas or air supply events in the cylinder cycle could be arranged in excess of one, a typical number would be two per cycle. The metered quantity of fuel may be delivered to the delivery injector by the fuel metering means in a fuel metering event timed at any time in the cylinder cycle relative to the gas supply events. For example, initiation of a first gas supply event may enable delivery to the combustion chamber of a portion, desirably a major proportion, of a metered fuel requirement for the engine per cylinder cycle under particular engine operating conditions. Some time later, but during the same cylinder cycle, a second gas or air supply event may deliver any remaining portion of the previously metered fuel amount to the combustion chamber. In some situations, this second air supply event may be initiated to scavenge any "hang-up" fuel remaining within the fuel delivery injector. It may be initiated either in association with an ignition event or not as desired. That is, a typical delivery injector has a holding chamber or bore through which fuel passes or is retained. A film of fuel may adhere to the walls of the chamber or bore following the first air event due to surface tension effects and it is this phenomenon that is referred to as fuel "hang-up" or "hang-up" fuel.

The proportion of fuel delivered to the combustion chamber in the first and subsequent gas supply events may be controlled by varying the timing, duration and/or delivery pressure of each gas supply event. The gas supply events then may be used to achieve splitting of the metered quantity of fuel into discrete pulses of known characteristics which facilitate efficient engine operation by ultimately achieving a predetermined fuel distribution in the combustion chamber at the point of ignition under any given engine operating conditions. Thus, for example, the amount of fuel delivered to the combustion chamber as a result of the first gas supply event may be determined so as to achieve a generally homogeneous mixture throughout the combustion chamber, but one that is not necessarily easily ignitable. Then, just prior to the point of ignition, a second gas supply event may occur in the same operating or cylinder cycle enabling delivery of a sufficient fuel quantity to specifically attain a desired ignitable air/fuel ratio at the ignition means. Such an air/fuel ratio is one recognised by one skilled in this art as being one within the ignitable range. Control of fuelling to the engine in this way is highly conducive to low emission stable engine operation.

As mentioned hereinbefore, the actual quantities of fuel delivered during the separate air supply events is a function of the timing of opening, duration, and/or delivery pressure associated with each air supply event. Accordingly, for the above example, the delivery injector would typically be held open for a longer period for the first air supply event as compared to the second air supply event. This would, of course, depend on the differential pressure drop across the delivery injector when opened, but would be true for a majority of cases.

Alternatively, it may be more beneficial in certain applications or implementations that the amount of fuel delivered to the engine during the first and second gas supply events be not too dissimilar. That is, the amount of fuel in delivered in each gas supply event may be approximately equal. Accordingly, the separate gas supply events may preferably be of similar durations to promote delivery of similar quantities of fuel entrained in air into the combustion chamber of the engine.

In an extension to this concept, all of the metered quantity of fuel may be delivered by the delivery injector during one of the multiple gas supply events to establish the pre-determined fuel distribution in the combustion chamber at ignition. The other gas supply event(s) may then be used to effect other desirable control strategies as will be discussed hereinafter. This is also applicable wherein fuel is supplied to the delivery injector in a plurality of fuel metering events as will also be discussed hereafter. Still further, the other control strategies referred to may, in certain applications, be effected during one of a number of gas supply events even when the gas supply event within a cylinder cycle is being used to deliver a quantity of fuel to the combustion chamber.

For example, in the case where two gas supply events are being affected per cylinder cycle, the subsequent gas supply event may occur late enough in the engine operating cycle such that, subsequent to effecting fuel delivery, the delivery injector may be retained open at a time when the cylinder pressure exceeds that in the chamber or bore of the delivery injector. Thus cylinder gases may be captured and utilised as a source of pressurised gas for subsequent gas supply events in a manner similar to that described in the Applicant's U.S. Pat. No. 4,936,279, the contents of which are hereby incorporated herein by reference.

Alternatively, the subsequent gas supply event may be used solely for this desired function with all of the metered quantity of fuel being delivered by the delivery injector during the first gas supply event. Hence this methodology may be used to accelerate pressurisation of an air rail on start-up for example or to reduce the air compressor load on the engine at other times. Further, because the bulk or all of the fuel has already been delivered to the engine during the first gas supply event, this gas capture function may be affected at timings and under engine operating conditions which would normally not be conducive to this function.

Still further, any subsequent gas supply event may also be used to affect injector cleaning, as is described in the Applicant's U.S. Pat. No. 5,195,482, the contents of which are herein incorporated herein by reference. That is, the subsequent gas supply event may, as per the previous gas capture concept, be affected late enough in the engine operating cycle such that the typically high temperature cylinder gases, which are caused to flow into the bore of the delivery injector, may be used to clean the surfaces of the delivery injector subject to carbon deposition (which may adversely affect the fuel delivery accuracy of the delivery injector) in a "clean routine". Thus, admission of cylinder gases to the delivery injector may cause combustion of undesirable carbon deposits and cleaning of the injector surfaces. As per the previous gas capture concept, use of the dual injection concept according to the present invention enables such a clean routine to be effected at timings and under engine operating conditions which normally would not be conducive to such a function. In particular, such an injector cleaning strategy may be effected at any point throughout the load and speed range of the engine as the operation of the engine can be maintained or adjusted as required by way of the fuel delivered to the engine during the first gas or air supply event.

In yet a further extension to this concept, the subsequent gas supply event may be used as a means for enabling provision of increased quantities of fuel to the engine in order to assist with rapid warming of an exhaust system catalyst. One such catalyst warming or "fast light-off" strategy is described in the Applicant's U.S. Pat. No. 5,655,365, the contents of which are hereby incorporated herein by reference. By way of the second or latter gas supply event in a dual injection strategy according to the present invention, late injection of additional fuel into the combustion chamber can be used to provide increased levels of heat energy to any downstream catalyst in the engine exhaust system instead of, or additionally to, the strategy of U.S. Pat. No. 5,655,365. Such fuel may be combusted in the combustion chamber and/or the exhaust system due to the timing of delivery thereof into the combustion chamber with respect to previous ignition event. Again, the use of the dual injection concept according to the present invention enables such a fast light-off strategy to be effected a, timings which would not normally be conducive to such a function and in a manner which may have less of an effect on normal engine running. Further exhaust gas temperature may be maintained above light off under light load running conditions.

In an alternative implementation of the dual injection concept according to the present invention, the fuel metering injector may be controlled to effect a plurality of, typically two, fuel metering events whilst the fuel delivery injector is also controlled to effect a plurality of, typically two, fuel delivery pulses or gas supply events. That is, a first quantity of fuel is metered into the delivery injector early in the cylinder cycle and this metered quantity of fuel is then delivered to the engine early in the cylinder cycle. This first quantity of fuel typically serves to create a homogeneous mixture in the combustion chamber of the engine. A second, generally comparatively much smaller, quantity of fuel is subsequently metered into the delivery injector and this is then delivered to the combustion chamber by way of a second gas supply event. This second gas supply event is generally timed much later in the cylinder cycle so as to provide a rich ignitable mixture around the ignition means just prior to, or at, ignition.

Hence, in this way, a similar desirable fuel distribution is achieved in the combustion chamber, as described hereinabove, by way of two separate fuel metering events and two separate gas supply events. It will be understood that the proportion of fuel metered in each fuel metering event can be varied, as may the proportion of injected air by varying fuel metering injector and delivery injector pulse widths or opening durations respectively. Again, it may be more beneficial in certain applications or implementations that the amount of fuel delivered to the delivery injector during the first and second fuel metering events be not too dissimilar. That is, the amount of fuel delivered in each fuel metering event may be approximately equal. Accordingly, the separate fuel metering events may preferably be of similar durations to promote delivery of similar quantities of fuel to the delivery injector.

Further, such a combination of fuel metering and gas supply events may also be used to effect the other desirable control strategies as previously discussed. That is, whether a latter gas supply event is used to deliver a quantity of fuel to the combustion chamber, or whether all of the fuel is delivered during an earlier gas supply event in the same cylinder cycle, the latter gas supply event may in certain circumstances be used to effect strategies such as cylinder pressure entrapment, injector cleaning and fast catalyst light-off as alluded to hereinbefore.

In yet a further alternative implementation of the dual injection concept according to the present invention, a desirable fuel distribution in the combustion chamber may be achieved by way of two fuel metering events and a single gas supply event. In such a scenario, a first fuel metering event may deliver the bulk of the fuel to be metered to the delivery injector which is subsequently opened to deliver all of this fuel quantity to the engine. However, rather than close the delivery injector once all of this fuel has been delivered, the delivery injector may be held open to deliver a second, smaller quantity of fuel which is subsequently metered into the delivery injector by way of a second, short fuel metering event. Once this second quantity of fuel has been delivered to the combustion chamber in a gas supply event, the delivery injector may be closed, hence having been opened for a single gas supply event only. Such an implementation also provides greater fuel-fluxing control as discussed further in the Applicant's U.S. Pat. No. 4,800,862, the contents of which are herein incorporated by reference.

Further, it may be possible in some applications, for an air rail pressurisation ("pump up" strategy) or delivery injector clean type control strategy to be effected by maintaining the delivery injector open after fuel delivery to the combustion chamber has been completed.

Common to each of the prior discussed implementations of the dual injection concept according to the present invention is the way in which a dual fluid fuel injection system is conveniently used to provide a desirable fuel distribution within the combustion chamber of the engine. That is, the dual fluid fuel injection system is preferably controlled in such a manner so as to deliver the bulk of a metered quantity of fuel into the combustion chamber at a point relatively early in the engine operating cycle, and subsequently controlled to deliver a remainder of the metered quantity of fuel at a point much later in the engine operating cycle.

Preferably, the dual fluid fuel injection system is controlled to provide a generally homogeneous mixture in the combustion chamber at a point relatively early in the engine cylinder cycle.

Preferably, the dual fluid injection system is controlled to provide a small, rich ignitable mixture around the ignition means at a point relatively late in the engine cylinder cycle and generally proximate, that is, just prior, to the timing of ignition.

In contrast to the dissimilar fuel quantities delivered to the engine in accordance with the above methodology, these alternative implementations of the dual injection strategy according to the present invention may equally be adapted to deliver separate, yet similar quantities of fuel to the engine as alluded to hereinbefore. That is, rather than a first gas supply event delivering the bulk of a metered quantity of fuel to the engine and a second gas supply event delivering a smaller quantity of fuel thereto, the separate events may deliver equal or other suitable ratios of fuel to the combustion chamber of the engine. Further, these alternate implementations of the dual injection strategy according to the present invention may be used so as to affect other desirable control strategies whilst still enabling a predetermined fuel distribution to be established in the combustion chamber(s) of the engine prior to ignition. In some cases where a second gas supply event is used solely to affect a desired engine control strategy, the predetermined fuel distribution in the combustion chamber will be established by means of the first gas supply event.

The method according to the present invention may readily be implemented in multi-cylinder engines of both two or four stroke type. The method has particular applicability to four stroke engines as the nature of operation of such engines provides for comparatively longer engine cylinder cycle times within which multiple fuel metering and/or gas supply events may be effected.

Figure 2:
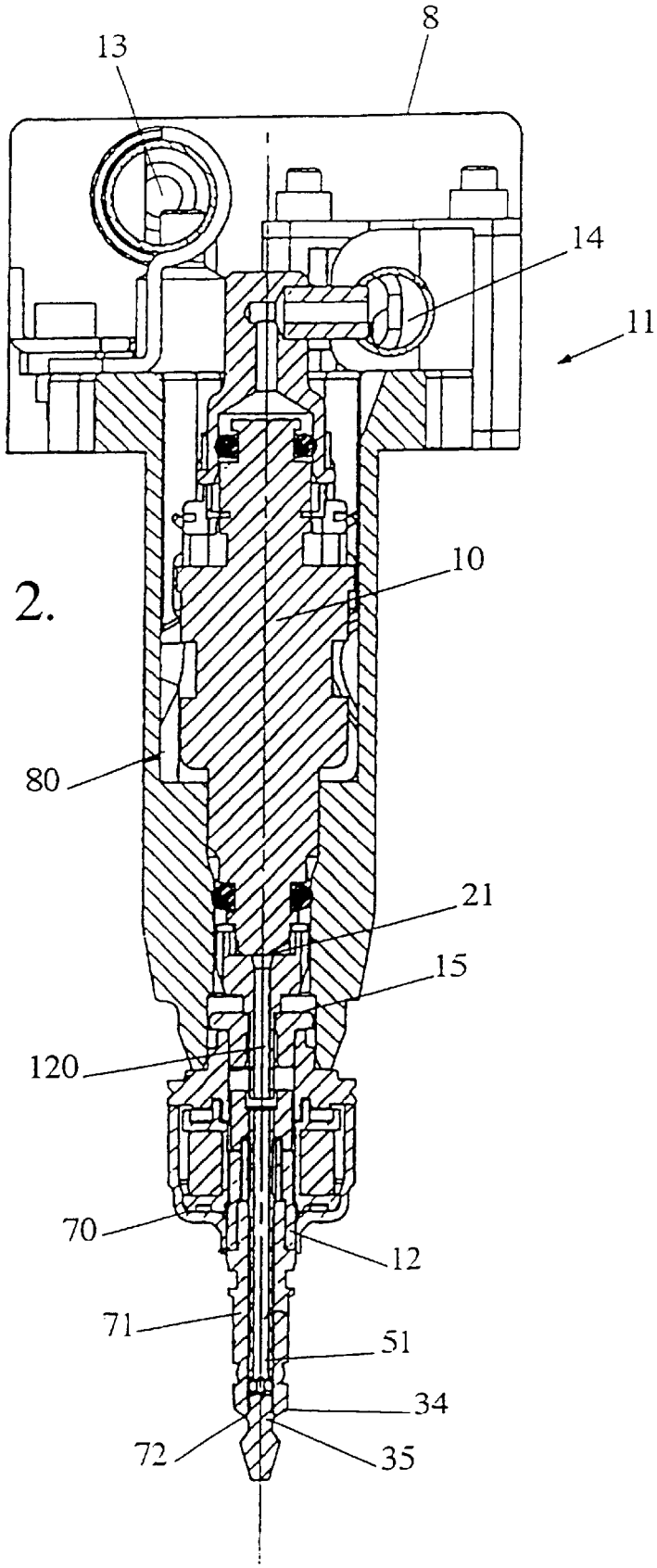
Figure 3:
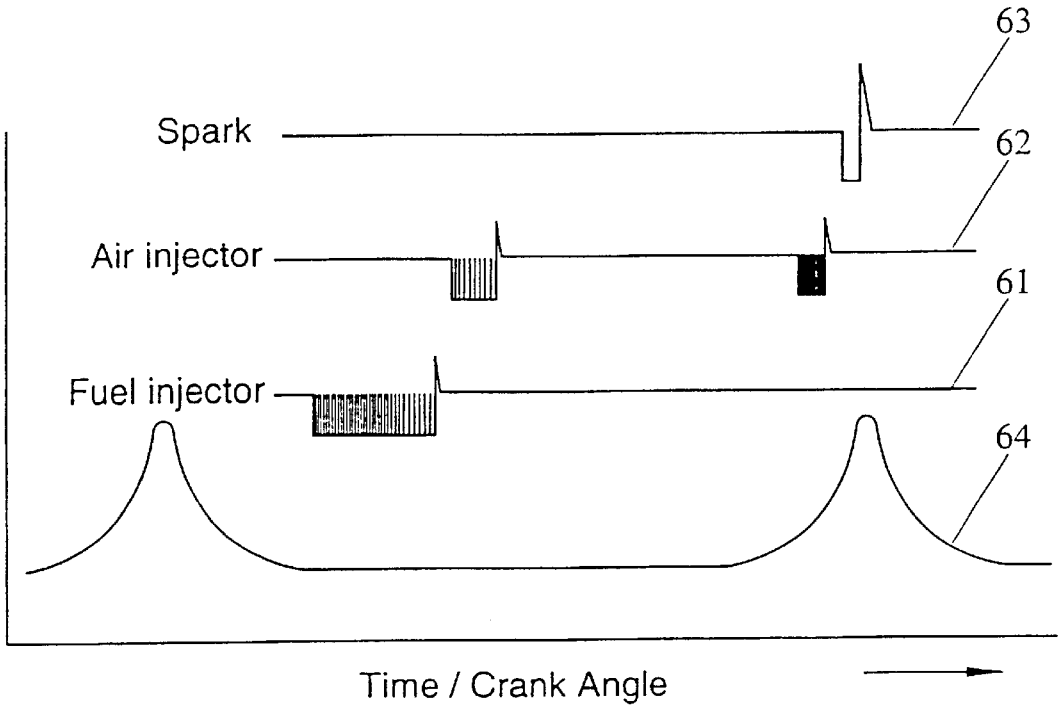

The invention will be more clearly understood from the following description of preferred embodiments thereof made with reference to the accompanying drawings in which:

FIG. 1 is a schematic diagram showing an engine operated in accordance with one embodiment of the method of the present invention;

FIG. 2 is a cross-sectional view through one embodiment of a metering and injector rail unit that may be used on the engine operated in accordance with one embodiment of the present invention as shown in FIG. 1; and FIG. 3 is a series of plots showing one example of certain specific timings and durations of a fuelling event and gas supply events of the components of the fuel injector and rail unit of FIG. 2 when operated in a mode according to the present invention.

FIG. 1 shows a direct injected dual overhead camshaft multi-cylinder four stroke internal combustion engine 20 having a cylinder 60 in which a piston 59 reciprocates, the piston 59 being connected through a conrod 58 to a crankshaft 33 of the engine 20. The engine 20 comprises an air intake system 22, an ignition means 24, a fuel pump 23, fuel reservoir 28 and an exhaust system 25. Mounted in a cylinder head 30 of the engine 20 is a fuel and air rail unit 11. An air compressor 29 is operatively arranged with respect to the engine 20 and typically driven off the engine crankshaft 33 by way of a suitable belt (not shown). The fuel pump 23 draws fuel from the fuel reservoir 28 which is then supplied to the fuel and air rail unit 11 through a fuel supply line 55. Conventional inlet and exhaust valves 15 and 16 are also mounted in the cylinder head 30 in the known manner together with conventional cam means 17 for actuating the valves 15, 16. The valves 15, 16 are arranged to open and close corresponding inlet and exhaust ports 18 and 19 for admission of fresh air and the removal of exhaust gases from the engine cylinder 60 during a cylinder cycle in the known manner.

The detachable cylinder head 30 has a cavity 31 formed within it which, at its deepest point has located therein an injection nozzle 34 of a delivery injector 12 of the fuel and air rail unit 11. The cavity 31, together with the piston 59 and the cylinder 60, defines a combustion chamber 32. Provision of the cavity 31 of appropriate shape and disposition in the cylinder head 30 assists in the formation of a stratified fuel distribution in the combustion chamber 32, particularly at low loads, in accordance with the disclosure in the Applicant's U.S. Pat. No. 4,719,880, the contents of which are hereby incorporated herein by reference. Later timing of fuel injection through the injection nozzle 34 into the cavity 31 under low load engine operating conditions also assists in the formation of a stratified change in the combustion chamber 32 under such conditions. A low spray penetration nozzle may also be employed for this purpose.

Referring now to FIG. 2, there is shown in greater detail the fuel and air rail unit 11. The fuel and air rail unit 11 comprises a fuel metering injector 10 and the air or delivery injector 12, with an appropriate interface 15 arranged therebetween. Respective fuel metering and fuel delivery injectors 10 and 12 are provided for each cylinder 60 of the engine 20. The body 8 of the fuel and air rail unit 11 may be an extruded component with a longitudinally extending air duct 13 and a fuel supply duct 14. Alternatively, the air duct 13 and/or the fuel duct 14 may be provided in the form of individual elongate tubular members.

As can be best seen from FIG. 1, at appropriate locations, there are provided connectors and suitable ducts communicating the rail unit 11 with the respective air and fuel supplies: air line 49 communicating air duct 13 with the air compressor 29; air line 53 providing an air outlet which returns air to the air intake system 22; and fuel line 52 communicating the fuel supply duct 14 to the fuel reservoir 28 providing a fuel return passage, as desired. The air duct 13 communicates with a suitable air regulator 27 which regulates the air pressure of the compressed air provided by the air compressor 29 to the air duct 13. Similarly, a fuel regulator 26 is provided to regulate the pressure of the fuel supplied by the fuel pump 23.

Pressurised air supplied by the air compressor 29 may be supplemented by use of a pump-up strategy as described in the Applicant's co-pending PCT Patent Application No. PCT/AU97/00438, the contents of which are hereby incorporated herein by reference. This strategy has advantages in terms of reducing the time delay from engine start-up before which satisfactory operating pressures may be achieved in the air duct 13. Further, the strategy may be employed to reduce the load of the air compressor 29 on the engine 20.

The fuel metering injector 10 has a metering nozzle 21 which is in communication with a chamber 51 formed within a valve stem of the delivery injector 12. In a particular embodiment of the present invention, the fuel metering injector 10 delivers, during each cylinder cycle, and on command of an electronic control unit (ECU) 100, a single metered quantity of fuel in a fuel metering event or pulse of controlled duration to the chamber 51 of the delivery injector 12 via the interface 15. The metered quantity of fuel will be understood to be a function of the open duration of the fuel metering injector 10.

The delivery injector 12 has a housing 70 with a cylindrical spigot 71 projecting from a lower end thereof, the spigot 71 defining an injection port 72 communicating with a passage 120 passing through the interface 15. The injection nozzle 34 includes a solenoid operated selectively openable poppet valve 35 operating in a manner similar to that described in the Applicant's U.S. Pat. No. 4,934,329, the contents of which are hereby incorporated by reference. As best seen in FIG. 1, energisation of the solenoid in accordance with commands from the electronic control unit (ECU) 100 causes the valve 35 to open to deliver a fuel-gas mixture to the combustion chamber 32 of the engine 20. However, it is not intended to limit the valve construction to that as described above. Other valves, for example, pintle valve constructions, could be employed instead.

The electronic control unit (ECU) 100 typically receives signals indicative of crankshaft speed and air flow from suitably located sensors within the engine (not shown). The ECU 100, which may also receive signals indicative of other engine operating conditions such as the engine temperature and ambient temperature (not shown) determines from all input signals received the quantity of fuel required to be delivered to each of the cylinders 60 of the engine 20. This general type of ECU is well known in the art of electronically controlled fuel injection systems and will not be described herein in further detail.

Opening duration and timing for each delivery injector 12 is controlled by the ECU 100 via a respective communicating means 101 in timed relation to the engine cycle to effect delivery of fuel from the injection port 72 to a combustion chamber 32 of the engine 20. By virtue of the taco fluid nature of the system, fuel is delivered to the combustion chamber 32 of the engine 20 entrained in a gas. The passage 120 is also in constant communication with the air duct 13 via the conduit 80, as shown in FIG. 2, and thus, under normal operation, is maintained at a substantially steady air pressure. Upon energising of the solenoid of the delivery injector 12, the desired proportion of the metered quantity of fuel delivered into the delivery injector 12 by the fuel metering injector 10 is carried by air through the injection port 72 into the combustion chamber 32 of a cylinder 60 of the engine 20.

The opening and closing times of the fuel metering and delivery injectors 10 and 12 are timed in relation to the engine cylinder cycle, for example relative to the ignition event, and to one another, by the ECU 100. These timings correspond with fuel metering and gas supply events which may be a function of the speed and load conditions of the engine 20 and may be mapped on the basis of experiment. Appropriate ignition timing is also typically provided by look-up maps within the ECU 100. Crank domain and/or time domain control is possible in respect of the aforementioned events.

In one embodiment of a dual injection fuel system control strategy according to the present invention, during each cylinder cycle of the engine 20, a single pulse of fuel is delivered to the chamber 51 of the delivery injector 12 by the fuel metering injector 10 in a single fuel metering event. Multiple gas supply events are then controlled to occur during the same cylinder cycle for delivering the fuel to the combustion chamber 32. As alluded to hereinabove, the timing of these events will be dictated by the ECU 100 in accordance with the speed and load conditions of the engine 20. Other factors, such as engine temperature, may also be accounted for. The timing of the gas supply events may be related to the timing of the fuel metering event(s) to achieve the objective of an optimum fuel distribution within the combustion chamber 32 at ignition.

In one case, to example, the fuel metering injector 10 may open earlier than the delivery injector 12 effecting a fuel pulse or fuel metering event in which a metered quantity of fuel is delivered into the chamber 51 of the delivery injector 12. A first gas supply event of controlled duration may then occur by opening the valve 35 of the delivery injector 12. As air will normally be the atomising and combustion supporting gas, the description hereinbelow will use the term "air supply event" to describe such an event. In this way, a portion, usually the bulk, of the requisite fuel is delivered to the engine combustion chamber 32 in this first air supply event.

In a two stroke engine, the first air supply event may be desirably timed prior to exhaust port closure and it may be desired to deliver upwards of 80% of the metered quantity of fuel at this stage. In a four stroke engine, the first air supply event may be desirably timed to occur at some point during the induction stroke. It is important to observe that the opening of the delivery injector 12 need not be in sequence with the fuel metering event. Each of the fuel metering and air supply events may be timed in any desired manner. In this regard, overlapping of the opening of the fuel metering and delivery injectors 10 and 12 may be implemented. Further, the time relationship between the closing of the delivery injector 12 and ignition may often be of importance. Timing of any or all of the events may be done in the time or crank domain as described, for example, in the Applicant's co-pending European Patent Application No. 0852668, the contents of which are hereby incorporated herein by reference.

The first air supply event may not discharge all of the fuel present within the chamber 51 of the delivery injector 12. For example, fuel may typically form an adherent film on the walls of the chamber 51 (ie: fuel "hang-up" occurs). Thus, some time after the first air supply event, a further air supply event may be implemented by a subsequent opening of injector nozzle 34 to scavenge into the combustion chamber 32 any fuel that was not delivered thereto by the first air supply event. Alternatively, rather than, or as well as, scavenging any fuel which may hang-up in the delivery injector 12, the second air supply event may be effected to deliver into the combustion chamber 32 a second, typically smaller, quantity of fuel which was not injected during the first air supply event (ie: the balance of the fuel quantity metered by the fuel metering injector 10 during the single fuelling event thereof). In a four stroke engine, the second air supply event may typically be timed to occur at a point during the compression stroke.

Hence, the amount of fuel delivered to the combustion chamber 32 in each discrete air supply event may be controlled by variation of the opening duration of the delivery injector 12, as well as its timing of opening with respect to the fuel metering injector 10 and the cylinder cycle. For example, at high loads, the timing of the air supply events may take place earlier in the engine operating cycle assisting homogeneous charge formation under such load conditions. Further, and as alluded to hereinbefore, similar or other suitable ratios or quantities of fuel may be delivered to the engine 20 in the separate first and second air supply events.

As alluded to hereinbefore, other implementations of the dual fluid injection system dual injection strategy according to the present invention may be used. For example, two separate quantities of fuel entrained in air may be delivered to the combustion chamber 32 of the engine 20 by way of two separate fuelling events and two separate respective air supply events. The fuel metering and air supply events may be appropriately timed with respect to one another such that each discrete metered quantity of fuel is followed by or overlaps with an air supply event in order for fuel to be delivered into the combustion chamber 32. As with the previously discussed implementation, similar or different ratios or quantities of fuel may be delivered to the engine 20 in the separate first and second air supply events.

In a further alternative implementation of the dual injection strategy according to the present invention, a single air supply event may be implemented in combination with two discrete fuel metering events as a different way of delivering two separate quantities of fuel entrained in air to the engine 20. Such an implementation would also be conducive to achieving different desirable fuel fluxing effects in accordance with the disclosure in the Applicant's U.S. Pat. No. 4,800,826.

In each of the aforementioned possible modes of dual injection by a dual fluid injection system, the first quantity of fuel entrained in air and delivered to the engine 20 is typically timed early enough in the cylinder cycle to achieve a homogeneous mixture prior to ignition. Advantageously, the mixture will be richer than stoichometric. Generally, this first quantity of fuel may be greater than a subsequent quantity delivered to the engine 20 (eg: in a second air supply event). Further, the delivery of a second quantity of fuel entrained in air and delivered to the engine 20 is typically timed late enough in the cylinder cycle to achieve a localised, rich ignitable mixture around the spark plug 24 just prior to, or at, ignition. Advantageously, the mixture will be richer than stoichiometric. Generally, this second quantity of fuel is comparatively small with respect to the quantity of fuel initially delivered (eg: in the first air supply event).

To emphasise these points, there follows a description of the fuel metering and air supply events occurring in a single cylinder cycle. This description is made with reference to the plots shown in FIG. 3. It should be noted that FIG. 3 relates to the dual injection strategy wherein one fuelling event and two air supply events are implemented and hence the total metered fuel quantity is delivered over two direct injection events. It therefore serves an illustrative, though non-limiting, purpose.

Plot 61 shows the delivery of a pulse of fuel from the fuel metering injector 10 into the chamber 51 of the delivery injector 12 (ie: a single fuel supply event). Plot 62 shows the injection of this metered quantity of fuel into the combustion chamber 32 by the delivery injector 12 in two separate delivery events (ie: two air supply events). Plot 63 shows the timing of ignition by the ignition means 24 relative to the metering of fuel by the fuel metering injector 10 and the delivery of fuel entrained in air by the delivery injector 12. Each of plots 61, 62 and 63 are shown in respect of plot 64 which is representative of a single cylinder cycle as defined by the period between the two peaks of the plot which are indicative of the TDC firing position of the piston 59 in the cylinder 60. The timings, as shown, are schematically given for a four stroke cycle engine. Hence, the period between the TDC firing position of the piston 59 is equivalent to 720° of crank angle rotation. Nonetheless, proportional similar timings and durations would be applicable in regard to a two stroke cycle engine whether single or multi-cylinder.

The specific timings of each event shown in the plots 61, 62 and 63 may be dependent upon a number of factors, in particular the speed and load of the engine. In the comments which follow, the indicative timings which are provided by way of example only, are representative of a four stroke cycle engine operating at around 3200 rpm. Such timings (ie: of commencement and cessation of an event) may be scheduled in either the crank angle domain or the time domain, or a combination of both, as is known according to prior known techniques. For example, such scheduling is described in the Applicant's copending European Patent Application No. 0852668.

As may be seen from plot 61, all of the metered quantity of fuel is delivered into the chamber 51 by the fuel metering injector 10 early on in the cylinder cycle. This fuel metering event may typically be timed to commence during the latter part of the exhaust stroke or during the early part of the induction stroke during the cylinder cycle. By way of example only, the fuelling event may occur between 465° to 335° BTDC (firing) in the cylinder cycle.

The first air supply event may then typically be timed to occur immediately following the cessation of the fuel metering event and would hence occur comparatively earlier in the cylinder cycle than the second air supply event. This first air supply event may hence be timed to commence during the early part of the induction stroke and would typically serve to deliver a majority of the fuel metered into chamber 51 directly into the combustion chamber 32. This would provide sufficient time for a relatively lean homogeneous mixture to be established in the combustion chamber 32 before the second air supply event and subsequent ignition event. By way of example only, the first air supply event may occur between 330° and 270° BTDC (firing) in the cylinder cycle.

As further shown in plot 62, the second air supply event is typically timed to occur much later in the cylinder cycle and may generally occur during the compression stroke of the piston 59. Generally, the second air supply event would be significantly shorter in duration than the first air supply event and would be effected to deliver the remaining portion of the metered quantity of fuel to the combustion chamber 32. The second air supply event may be effected to scavenge any fuel hang-up from the chamber 51 of the delivery injector is effected to provide a richer, ignitable air/fuel mixture around the spark plug 24 just prior to ignition. Accordingly, and by way of example only, the second air supply event may be scheduled to occur between 180° and 155° BTDC (firing). Ignition of the fuel/air mixture within the combustion chamber 32, as shown in plot 63, would then typically occur just prior to TDC (firing) and, by way of example only, may be scheduled to occur at around 30° BTDC (firing).

Hence, depending upon the timing and duration of each air supply event in the engine operating cycle, the plurality of air supply events may be used to divide the metered quantity of fuel between multiple discrete air supply events, as shown in plot 62.

The ECU 100 may be used to control the timing and other characteristics of any of the parameters of fuel metering, fuel injection and ignition timing and, accordingly, by suitable timing of the fuel and gas events, optimum fuel distribution may be achieved in the combustion chamber 32 of the engine 20 at ignition or otherwise as desired, either in relation to engine speed and/or load, or independently of these variables.

The implementation of this strategy enables the combustion system to be operated at higher gas/fuel ratios (including trapped residuals and exhaust gas recirculation or "EGR") without sacrificing combustion stability, which may then enable higher levels of EGR to be applied. The strategy is particularly effective in the medium to high load region which typically corresponds in some direct injected four stroke engines to the transition area from lean stratified combustion to lean homogeneous operation. Further, fuel economy improvement is possible without effecting engine emissions by use of this strategy, primarily due to the ability to run leaner and with increased levels of EGR.

As alluded to hereinbefore, the dual fluid fuel injection strategy according to the present invention may also be used to effect other desirable control strategies. This is particularly so for implementations of the dual fluid fuel injection strategy wherein multiple air supply or air injector events are used.

For example, and as alluded to hereinbefore, a second air supply event may occur late enough in the engine operating/cylinder cycle such that the chamber 51 within the delivery injector 12 is at lower pressure than the pressure in the cylinder 60, hence allowing cylinder gases to flow into the chamber 51. This may be employed as an alternative source of pressurised gas for the delivery injector 12 analogous to the methodology described in the Applicant's PCT Patent Application No. PCT/AU97/00438. That is, having delivered a portion or all of a metered quantity of fuel to the engine cylinder 60 by way of a first air supply event, the second air supply event is used to provide some pressurisation of the air duct 13. This second air supply event may be used solely to effect this desired pressurisation, or may also be used to deliver a further portion of fuel to the cylinder 60. In this latter respect, the operation of the delivery injector 12 would be simply timed such that subsequent to the delivery of a further quantity of fuel, the injector nozzle 34 would be maintained open for a predetermined period to enable high pressure gas to flow through the injection port 72 and into the air duct 13.

In a similar way, the second or latter air supply event may be used to effect cleaning of the delivery injector 12 as described hereinbefore. In this regard, it will be understood that the temperature of the cylinder gases may, at certain times, be sufficient to allow for the burning off of any carbon deposits that may have formed on the injector nozzle 34 and poppet valve 35 of the delivery injector 12. This serves a valuable purpose in cleaning the injector nozzle 34 for assuring accurate and repeatable delivery of fuel to the combustion chamber 32. This is analogous to the methodology described in the Applicant's U.S. Pat. No. 5,195,482, the contents of which are hereby incorporated herein by reference. Such a "clean routine" may be achieved typically where the second air event is timed to occur late in the engine operating cycle.

In this regard, as well as delivering a portion of fuel to the cylinder 60, a latter air supply event may be timed such that maintaining the injection port 32 open after the fuel has been delivered and ignited will enable high temperature cylinder gases to pass over and clean the injector nozzle 34 and poppet valve 35 of the delivery injector 12. Alternatively, the latter air supply event may be controlled to solely enable a clean routine to be effected. In this scenario, the predetermined fuel distribution in the combustion chamber is established by the first air supply event, the second air supply event being used solely to enable a clean routine to be effected. Accordingly, the second air supply event will be controlled to occur at a point in the cylinder cycle wherein the temperatures and pressures in the cylinder 60 exceed those within the delivery injector 12. Hence, such a clean routine achieved by implementing the latter air supply event in accordance with the dual injection strategy of the present invention, will typically occur after ignition of the fuel delivered into the cylinder 60 during the first air supply event.

Still further, implementations of the dual fluid fuel injection strategy according to the present invention may be used to assist with rapid warming of an exhaust emissions catalyst which may be operatively arranged in the engine exhaust system 25. Such a strategy shares some similarities with the control strategy described in the Applicant's U.S. Pat. No. 5,655,365. It is known from this patent that rapid warming of a catalyst to promote "light-off" thereof can be achieved by providing extra energy to the catalyst, typically during start-up of the engine. This extra energy is typically introduced in the form of fuel which combusts at, or upstream of, the catalyst such that a greater than normal amount of heat energy may be transferred to the catalyst substrate. This extra heat energy typically serves to raise the operating temperature of the catalyst above the light-off temperature thereof such that satisfactory gas conversion efficiency can result.

Accordingly, where the dual injection strategy incorporates use of a second or latter air supply event, this air supply event may be used to transfer a greater than normal quantity of fuel to the engine. For example, the second air supply event may be affected subsequent to an ignition event and at a point in the cylinder cycle wherein any fuel delivered during the second air supply event will be combusted in the cylinder and/or the exhaust system 25 due to the previous combustion event. For example, the second air supply event may be affected at a point after the top dead centre (TDC) position of the piston 59 during the expansion stroke or exhaust stroke thereof. The use of such a control strategy is particularly applicable to engine operation at start-up, but is equally applicable to any engine operating conditions wherein the catalyst may fall below its light-off temperature and extra heat energy is required to rapidly increase the operating temperature of the catalyst.

Alternatively, the extra fuel delivered into the combustion chamber 32 by the second or latter gas supply event may be combusted in the cylinder 60 and/or exhaust system by an associated second retarded ignition event. Further, whilst the extra fuel to promote catalyst light-off may be delivered into the delivery injector 12 by a second fuel metering event, it may sometimes be advantageous to deliver fuel required to promote catalyst light-off as part of a single large fuel metering event. This quantity would then be delivered to the engine 20 over two air supply events, with the second air supply event being controlled such that the necessary quantity of fuel is supplied to the engine to promote catalyst light off.

While the description of the dual injection method has been made with reference to drawings depicting a four stroke engine 20, the method may equally be implemented in direct injected two stroke engines. Indeed, it is possible to implement the method by retro-fitting suitable fuel metering and injection units and control units into four or two stroke engines of otherwise conventional design. Such retro-fitting may be facilitated by the use of sub-assemblies of the kind disclosed for example in the Applicant's Australian Provisional Patent Application No. PP3239 filed on Apr. 28, 1998, the contents of which are hereby incorporated by reference.

Modifications and variations may be made to the invention described herein as would be understood by one skilled in the art reading the disclosure. Such modifications and variations are within the scope of the present invention.

The claims defining the invention are as follows:

1. A method of fuelling an internal combustion engine by injection of a fuel-gas mixture to a combustion chamber of the engine, the method comprising the following steps:

delivering a metered quantity of fuel from a fuel metering means to a delivery injector, wherein the delivery injector is in communication with both the combustion chamber and a supply of pressurized gas to deliver the metered quantity of fuel to the combustion chamber;

controlling the delivery injector to provide multiple gas supply events over a cylinder cycle of at least one cylinder of the engine; and obtaining a predetermined fuel distribution in the combustion chamber of the at least one cylinder of the engine at ignition.

2. The method of claim 1 wherein said fuel metering means is controlled to effect a single fuel metering event of controlled duration for providing a metered quantity of the fuel to the delivery injector.

3. The method of claim 1 wherein said fuel metering means is controlled to effect a plurality of fuel metering events of controlled duration for providing a metered quantity of the fuel to the delivery injector.

4. The method of claim 1 wherein fuel is delivered to the combustion chamber of the engine in only one of the multiple delivery injector events.

5. The method of claim 1, wherein said delivery injector is controlled to effect a plurality of gas supply events for delivering the metered quantity of fuel to the combustion chamber of the engine.

6. The method of claim 1 wherein said delivery injector is arranged to deliver the metered quantity of fuel directly into the combustion chamber of the engine.

7. The method of claim 1 wherein the timing of each fuel metering event and gas supply event is controllably timed relative to ignition timing.

8. The method of claim 1 wherein the timing of said fuel metering and gas supply events are controllably timed relative to each other.

9. The method of claim 1 wherein the timing and/or duration of said fuel metering and gas supply events are a function of at least one of engine speed and engine load.

10. The method of claim 1 wherein said fuel metering and gas supply events are overlapped.

11. The method of claim 1 wherein the metered quantity of fuel is delivered to the delivery injector by the fuel metering means in a fuel metering event timed at any time in the cylinder cycle relative to a gas supply event.

12. The method of claim 1 wherein, in a first gas supply event, a major proportion of the metered quantity of fuel is delivered to the combustion chamber of the engine.

13. The method of claim 12 wherein, in a subsequent gas supply event, the remaining portion of the metered quantity of fuel is delivered to the combustion chamber of the engine.

14. The method of claim 1, wherein a subsequent gas supply event scavenges the delivery injector of fuel hang-up.

15. The method of claim 1, comprising controlling the proportion of fuel delivered in a gas supply event by varying at least one of the group consisting of timing, duration and delivery pressure of air to said delivery injector for said gas supply event.

16. The method of claim 1 wherein a generally homogeneous mixture is formed in the cylinder relatively early in the engine cylinder cycle.

17. The method of claim 16 wherein the homogenous mixture is relatively non-ignitable.

18. The method of claim 1 wherein a rich ignitable mixture is formed at the ignition means relatively late in the engine cylinder cycle.

19. The method of claim 18 wherein said rich ignitable mixture is formed generally proximate to the timing of ignition.

20. The method of claim 1 wherein, prior to ignition, a second gas supply event delivers sufficient fuel to attain a desired ignitable air/fuel ratio at an ignition means.

21. The method of claim 1 wherein an amount of fuel delivered to the combustion chamber in each gas supply event is approximately equal.

22. The method of claim 21 wherein the duration of each gas supply event is controlled to deliver approximately equal amounts of fuel to the combustion chamber in each gas supply event.

23. The method of claim 1 wherein one or more gas supply events are used to effect a desired engine control strategy.

24. The method of claim 1 wherein said delivery injector is opened or maintained open when the cylinder pressure exceeds the pressure within the delivery injector for capturing cylinder gases as a source of pressurized gas for subsequent gas supply events.

25. The method of claim 24 wherein said delivery injector is opened in a second gas supply event for capturing cylinder gases as a source of pressurized gas.

26. The method of claim 1 wherein said delivery injector is maintained open after delivery of a portion of the metered quantity of fuel to the combustion chamber.

27. The method of claim 1 wherein said delivery injector is opened or maintained open for allowing cylinder gases to clean the delivery injector.

28. The method of claim 1 wherein said delivery injector is opened or maintained open after an ignition event for allowing cylinder gases to clean the delivery injector.

29. The method of claim 28 wherein said delivery injector is opened or maintained for injector cleaning at any point of the engine speed or engine load range.

30. The method of claim 1 wherein said delivery injector is opened to deliver additional fuel to the engine for promotion of catalyst light off.

31. The method of claim 30 as dependent from wherein delivery of said additional fuel is effected by a second or subsequent gas supply event.

32. The method of claim 30 wherein said delivery injector is opened during an expansion or exhaust stroke after an ignition event.

33. The method of claim 1 comprising controlling the proportion of fuel metered in each fuel metering event by varying the pulse width of said fuel metering means.

34. The method of claim 16 of delivering fuel in a first gas supply event establishes a generally homogeneous mixture in the cylinder relatively early in the engine cycle.

35. The method of claim 1 wherein said gas is air.

36. The method of claim 1 wherein said engine is a multi-cylinder engine.

37. The method of claim 1 wherein said engine is a four stroke engine.

38. The method of claim 37 wherein said first gas supply event occurs during the induction stroke.

39. The method of claim 37 wherein a second or subsequent gas supply event occurs during the compression stroke.

40. The method of claim 1 wherein said engine is a two stroke engine.

41. The method of claim 1 wherein a predetermined fuel distribution in the combustion chamber is provided by a first gas supply event and a second or subsequent gas supply event is effected to achieve a desired engine control strategy.

42. An engine control unit for controlling an internal combustion engine, the engine comprising at least one fuel metering means in fluid communication with at least one delivery injector, the at least one delivery injector in fluid communication with a combustion chamber of the engine and a supply of pressurized gas; the engine control unit programmed to control the fuel metering means to meter fuel in a metering event to the delivery injector and to control the delivery injector to deliver fuel and pressurized gas in a delivery event to the combustion chamber wherein the delivery injector is controlled by the engine control unit to provide multiple gas supply events over a cylinder cycle of at least one cylinder of the engine such that a predetermined fuel distribution is obtained in the combustion chamber of the at least one cylinder of the engine at ignition.

43. The engine control unit of claim 42, wherein said fuel metering means is controlled to effect a single fuel metering event of controlled duration for providing a metered quantity of the fuel to the delivery injector.

44. The engine control unit of claim 42, wherein said fuel metering means is controlled to effect a plurality of fuel metering events of controlled duration for providing a metered quantity of the fuel to the delivery injector.

45. The engine control unit of claim 42, wherein fuel is delivered to the combustion chamber of the engine in only one of the multiple delivery injector events.

46. The engine control unit of claim 42, wherein said delivery injector is controlled to effect a plurality of gas supply events for delivering the metered quantity of fuel to the combustion chamber of the engine.

47. The engine control unit of claim 42, wherein said delivery injector is arranged to deliver the metered quantity of fuel directly into the combustion chamber of the engine.

48. The engine control unit of claim 42, wherein the timing of each fuel metering event and gas supply event is controllably timed relative to ignition timing.

49. The engine control unit of claim 42, wherein the timing of said fuel metering and gas supply events are controllably timed relative to each other.

50. The engine control unit of claim 42, wherein the timing and/or duration of said fuel metering and gas supply events are a function of at least one of engine speed and engine load.

51. The engine control unit of claim 42, wherein said fuel metering and gas supply events are overlapped.

52. The engine control unit of claim 42, wherein the metered quantity of fuel is delivered to the delivery injector by the fuel metering means in a fuel metering event timed at any time in the cylinder cycle relative to a gas supply event.

53. The engine control unit of claim 42, wherein, in a first gas supply event, a major proportion of the metered quantity of fuel is delivered to the combustion chamber of the engine.

54. The engine control unit of claim 53, wherein, in a subsequent gas supply event, the remaining portion of the metered quantity of fuel is delivered to the combustion chamber of the engine.

55. The engine control unit of claim 42, wherein a subsequent gas supply event scavenges the delivery injector of fuel hang-up.

56. The engine control unit of claim 42, wherein the proportion of fuel delivered in a gas supply event is controlled by varying at least one of the group consisting of timing, duration and delivery pressure of air to said delivery injector for said gas supply event.

57. The engine control unit of claim 42, wherein a generally homogeneous mixture is formed in the cylinder relatively early in the engine cylinder cycle.

58. The engine control unit of claim 57, wherein the homogeneous mixture is relatively non-ignitable.

59. The engine control unit of claim 42, wherein a rich ignitable mixture is formed at an ignition means relatively late in the engine cylinder cycle.

60. The engine control unit of claim 59, wherein said rich ignitable mixture is formed generally proximate to the timing of ignition.

61. The engine control unit of claim 42, wherein, prior to ignition, a second gas supply event delivers sufficient fuel to attain a desired ignitable air/fuel ratio at an ignition means.

62. The engine control unit of claim 42, wherein an amount of fuel delivered to the combustion chamber in each gas supply event is approximately equal.

63. The engine control unit of claim 62, wherein the duration of each gas supply event is controlled to deliver approximately equal amounts of fuel to the combustion chamber in each gas supply event.

64. The engine control unit of claim 42, wherein one or more gas supply events are used to effect a desired engine control strategy.

65. The engine control unit of claim 42, wherein said delivery injector is opened or maintained open when the cylinder pressure exceeds the pressure within the delivery injector for capturing cylinder gases as a source of pressurized gas for subsequent gas supply events.

66. The engine control unit of claim 65, wherein said delivery injector is opened in a second gas supply event for capturing cylinder gases as a source of pressurized gas.

67. The engine control unit of claim 42, wherein said delivery injector is maintained open after delivery of a portion of the metered quantity of fuel to the combustion chamber.

68. The engine control unit of claim 42, wherein said delivery injector is opened or maintained open for allowing cylinder gases to clean the delivery injector.

69. The engine control unit of claim 42, wherein said delivery injector is opened or maintained open after an ignition event for allowing cylinder gases to clean the delivery injector.

70. The engine control unit of claim 66, wherein said delivery injector is opened or maintained open for injector cleaning at any point of an engine speed or engine load range.

71. The engine control unit of claim 42, wherein said delivery injector is opened to deliver additional fuel to the engine for promotion of catalyst.

72. The engine control unit of claim 71, wherein delivery of said additional fuel is effected by a second or subsequent gas supply event.

73. The engine control unit of claim 71, wherein said delivery injector is opened during an expansion of exhaust stroke after an ignition event.

74. The engine control unit of claim 42, wherein a proportion of fuel metered in each fuel metering event is controlled by varying a pulse width of said fuel metering means.

75. The engine control unit of claim 57, wherein fuel delivered in a first gas supply event establishes a generally homogeneous mixture in the cylinder relatively early in the engine cylinder cycle.

76. The engine control unit of claim 42, wherein said gas is air.

77. The engine control unit of claim 42, wherein said engine is a multi-cylinder engine.

78. The engine control unit of claim 42, wherein said engine is a four stroke engine.

79. The engine control unit of claim 78, wherein first gas supply event occurs during an induction stroke.

80. The engine control unit of claim 78, wherein a second or subsequent gas supply event occurs during a compression stroke.

81. The engine control unit of claim 42, wherein said engine is a two stroke engine.

82. The engine control unit of claim 42, wherein predetermined fuel distribution in the combustion chamber is provided by a first gas supply event and second or subsequent gas supply event is effected to achieve a desired engine control strategy.

* * * * *